US005745082A

United States Patent [19]

Alder

[11] Patent Number: 5,745,082

[45] Date of Patent: Apr. 28, 1998

[54] RADIATION SENSOR

[75] Inventor: Christopher J. Alder, Malvern, United Kingdom

[73] Assignee: The Secretary of State for Defence in Her Britannic Majesty's Government of the United Kingdom of Great Britain and Northern Ireland, Hants, United Kingdom

[21] Appl. No.: 569,092

[22] PCT Filed: Jun. 13, 1994

[86] PCT No.: PCT/GB94/01262

§ 371 Date: Aug. 21, 1995

§ 102(e) Date: Aug. 21, 1995

[87] PCT Pub. No.: WO95/00982

PCT Pub. Date: Jan. 5, 1995

[30] Foreign Application Priority Data

Jun. 25, 1993 [GB] United Kingdom ..... 9313109

[51] Int. Cl.[6] ..... H01Q 19/06; H01Q 15/02

[52] U.S. Cl. ..... 343/753; 343/909; 343/911 R

[58] Field of Search ..... 343/753, 754, 343/909, 700 MS, 755, 756, 911 R; H01Q 19/06, 15/02, 15/24

[56] References Cited

U.S. PATENT DOCUMENTS

| | | | |
|---|---|---|---|
| 3,708,796 | 1/1973 | Gilbert | 343/909 |
| 4,447,815 | 5/1984 | Ghekroun | 343/909 |
| 4,975,712 | 12/1990 | Chen | 343/753 |
| 5,574,471 | 11/1996 | Sureau | 343/909 |

*Primary Examiner*—Hoanganh T. Le
*Attorney, Agent, or Firm*—Nixon & Vanderhye P.C.

[57] ABSTRACT

A radiation sensor (10) for the microwave and millimeter-wave regions incorporates a lens (12) having two parallel focal planes (26a, 36), these being defined by a polarization-selective reflecting PIN diode array (18) within the lens (12). One focal plane (26a) is occupied by a receive array of crossed dipole antennas which mixes receive signals and a local osicllator signal to produce intermediate frequency signals for subsequent processing. The second focal plane (36) is occupied by a transmit antenna array of separately activatable polarization switching antennas arranged to define a range of transmit beam directions. A second PIN diode array (20) protects the receive antenna array from the transmit beam.

18 Claims, 4 Drawing Sheets

FIG. 5
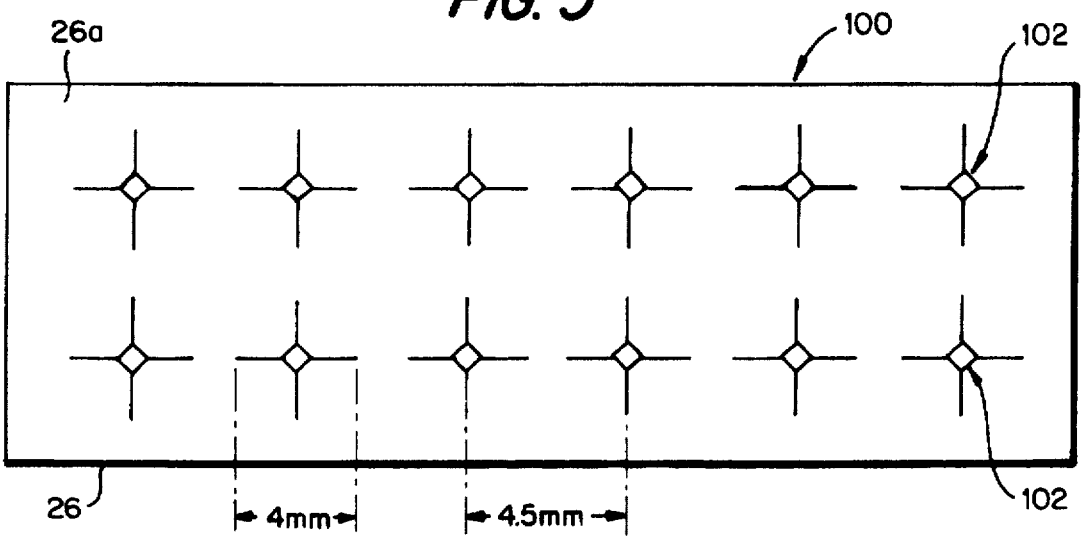
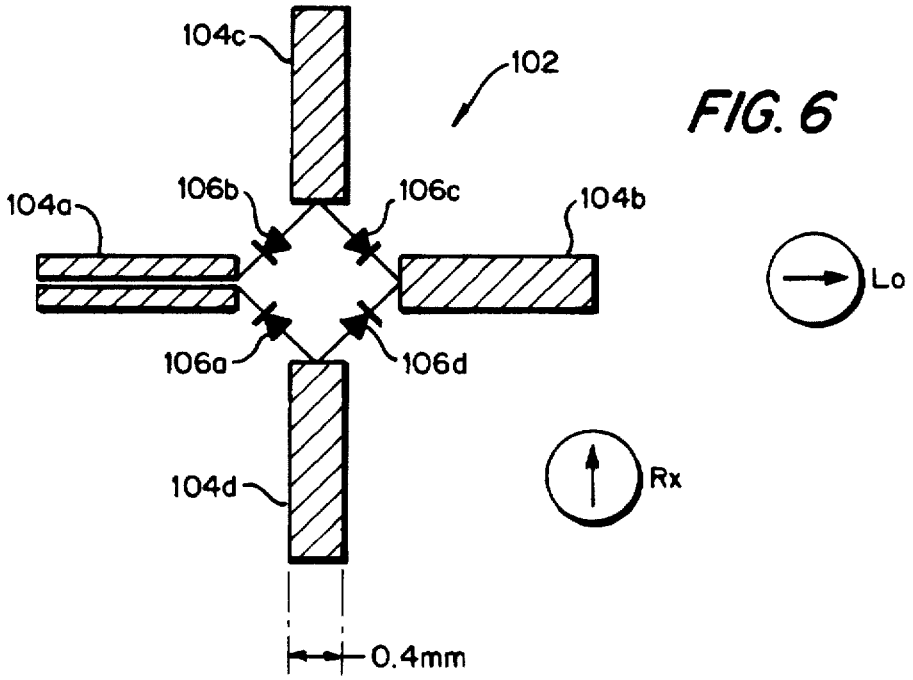
FIG. 6

RADIATION SENSOR

BACKGROUND OF THE INVENTION

1. Field of the Invention

This invention realtes to a radiation sensor, and more particularly, but not execulsively, to such a device for use in radar or communications systems a frequencies in the microwave and millimetre-wave regions of 10 GHz and above.

2. Discussion of Prior Art

Radiation sensors are well known in the prior art. U.S. Pat. No. 4,331,957 describes a dipolar antenna employed in a radar transponder device and used for location of avalanche victims and the like. It is a substantialy omindirectional device, this being a proterty of dipolar antennas, and consequently does not provide directional scene inforamtion. It cannot be used to identify target bearings, and is a short range device (eg 15 meters).

Many radiation sensors are employed as radars, which may be required to provide directional scene information at ranges of the order of kilometers or more. This requires scanning with a directional antenna device such as those employed in the missile seeker field. U.S. Pat. No. 4,199,762 describes a support for a radar antenna, the support being mechanically scanned about two orthogonal axes by virtue of a gimballed mounting. Such a device is compartively bulky and expensive. Moreover, a mechanically scanned antenna is sensitive only to objects within the antenna beam. Fast moving objects passing through the scanned volume need not necessarily encounter the antenna beam.

To overcome the deficiencies of mechanically scanned radars, electronically scanned devices have been developed. Such a device incorporates an array of emitting and/or receiving antennas. The transmit or receive beam direction is controlled by appropriate phasing of the drive signal or local oscillator signal at each antenna. A phased array radar referred to a "MESAR" was disclosed at a conference entitled RADAR 87, London, United Kingdom, 19–21, Oct. 1987. MESAR consisted of an array of 918 waveguide radiating elements arranged in a square of side 2 meters.

Antenna arrays based on dipoles engulfed (ie encapsulated) in dielectric materials are disclosed in U.S. Pat. No. 3,781,896. This disclosure is however silent regarding the formidable design problems involved in feeding signals to and from such an array. It is also silient as regards achieving the required directional properties and measurements.

A further form of radiation sensor is disclosed by Zah et al. in the International Journal of Infrared and Millimeter Waves, Volume 6, No. 10, 1985. It consists of a one-dimensional array of bow tie antennas with integrated diodes arranged in the image plane of a lens system comprising an objective lens and a substrate lens. The signal received by the antennas may be plotted as a function of antenna position to provide an imate. This device has the drawback that it is limited to reception mode operation. Moreover, it only detects radiation having a component polarized parallel to the antennas. There is no transmission capability, nor any provision for detection of other polarizations. A frequent requirement of radar sensors is that they provide for transmission and reception through a single aperture.

Microwave and millimeter-wave staring array technology is described by Alder et al. in the Proceedings of the 20th European Microwave Conference 1990 on pages 454–459. Lens-fed microwave and millimeter-wave receivers with integral antennas as described by Alder et al. on pages 449–453 of the same proceedings.

SUMMARY OF THE INVENTION

It is an object of the invention to provide an alternative form of radiation sensor.

The present invention provides a radiation sensor having radiation guiding means for guiding radiation, the guiding means defining a first plane and a second plane to or from which radiation is to pass, with either receiving means or transmitting means being located in the vicinity of each plane, characterised in that the radiation sensor includes switchable reflecting means for selectably performing the functions of reflecting and transmitting incident radiation.

For the purposes of this specification, the expression "in the vicinity of" shall be construed to mean "within one wavelenght at the sensor operating frequency", the wavelenght being that within the medium immediately adjacent the receiving or transmitting means as appropriate.

The invention provides the advantage that it offers a degree of protection to the radiation receiving means from stray RF radiation.

The switchable reflecting means may be a monolithic array of PIN diodes arranged to reflect one signal polarization and to transmit another in an OFF state and to reflect both polarizations in an ON state, the array being parallel to both focal planes. The array may be sandwiched between planar faces of respective lens portions. One lens portion may be shaped as a spherical cap and a second lens portion may be frusto-conical. This provides a very compact form of construction realizable with comparatively low density inexpensive materials.

In a preferred embodiment, the first focal plane array is two diemnsional and comprises crossed dipole antennas. One dipole of each antenna is parallel to the polarization of receive radiation incident on it from the reflecting means. In this embodiment, the sensor incorporates a signal generator arranged to supply to the first focal plane array a local oscillator signal polarized parallel to each antenna's second dipole. One of the dipoles may include a divided limb acting as an intermediate frequency transmission line. A second monolithic PIN diode array is arranged to limit the radiation incident on the antennas, in order to protect the antennas both from a high power transmit signal and from stray radiation directed towards the sensor. This embodiment of the invention provides for the transmission and reception of linearly polarized RF radiation through the same aperture.

A circular polarizer may be incporated in the sensor to transmit and receive circularly polarized radiation through a single aperture. The sensor may either by configured to detect the same polarization as that transmitted or an orthogonal polarization.

The invention also provides a radiation sensor including a converging dielectric lens arranged to define an optical aperture and an optical axis through the aperture characterised in that:

(a) the lens incorporates polarization-selective reflecting means for defining first and second focal planes at respective lens surface regions extending across the optical axis, (b) the reflecting means provides means for controllably reflecting radiation of one polarization and transmitting radiation of another polarization, (c) a receive array of antennas is located in the vicinity of the first focal plane, each antenna of the array being arranged to receive radiation entering the sensor from a respective beam direction relative to the optical axis and being coupled predominantly to radiation passing through the lens, and (d) in the vicinity of the second focal plane there is directionally selective transmitting means for coupling radiation through the lens to a plurality of output beam directions.

BRIEF DESCRIPTION OF THE DRAWINGS

In order that the invention may be more fully understood, embodiments thereof will now be described with reference to the accompanying drawings, in which:

FIG. 5 schematically shows a receive antenna array incorporated in the FIG. 1 sensor;

FIG. 6 is a plan veiw of a crossed dipole antenna of the FIG. 5 array.

DETAILED DISCUSSION OF PREFERRED EMBODIMENTS.

Figure 1:
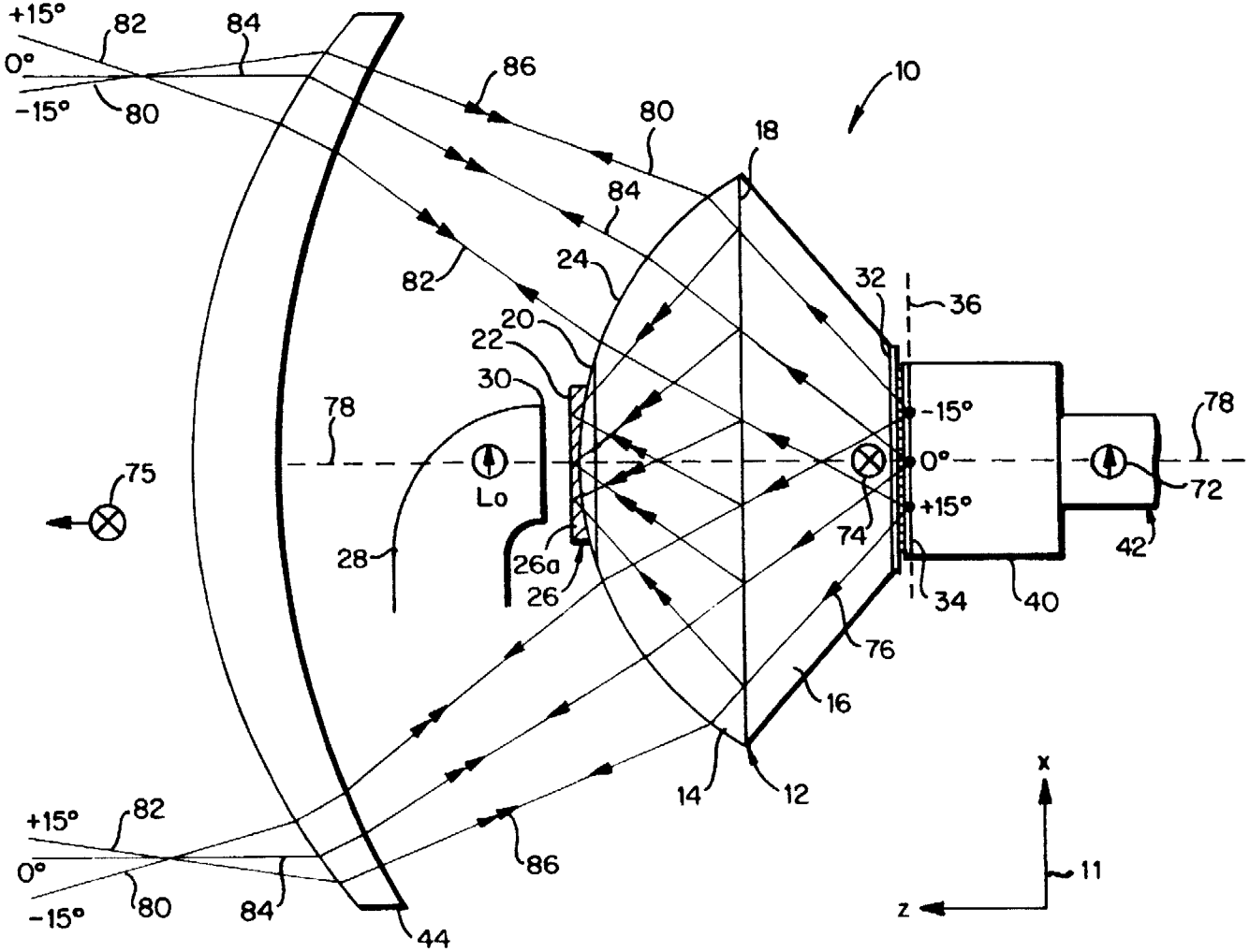
FIG. 1 is a sshematic sectional side view of a radiation sensor of the invention.

Referring to FIG. 1, there is shown a radiation sensor of the invention, indicated generally by 10. Cartesian reference axes are shown at 11, indicating orthogonal x and z reference axes; the y axis is not shown as it is perpendicular to the plane of the drawing. The sensor 10 is designed for operation at a microwave frequency of 16 GHz. it incorporates a dielectric lens 12 having a spherical cap portion 14 and a frusto-conical portion 16, these portions having ciruclar end faces (not shown) of equal size adjacent one another. The lens portions 14 and 16 are of alumina, and have a dielectric constant of 10. The adjacent end faces are 6.6 cm in diameter, and the spherical cap height or maximum thickness perpendicular to its circular face is 1.9 cm.

A first array of PIN diodes 18 is sandwiched between the adjacent faces of the lens portions 14 and 16. The first diode array 18 is planar and arranged perpendicular to the plane of the drawing. The diode array 18 will be described in more detail later. The spherical cap 14 incorproates a second planar PIN diode array 20, whose plane is also perpendicular to the plane of the drawing. The second array 20 is sandwiched between first and second divisions 22 and 24 of the cap 14, and its plane is parallel to that of the first array 18. It has a form similar to that of the array 18 except that it has a smaller surface area. The diode arrays 18 and 20 consist of a plurality of equally sapced co-parallel bias conductors (not shown) with monolithic PIN diodes (not shown) connected between the conductors. The bias conductors of the diods arrays 18 and 20 extend parallel to the x axis.

The bias conductors of each of the first and second arrays 18 and 20 are connected to a respective switchable current supply (not shown). Electrical connection to the bias conductors is made at the edge of each array.

A planar sheet substrate 26 of alumina material is attached to the first division 22 of the cap 14, the plane of the substrate 26 being parallel to those of the arrays 18 and 20. As will be described in more detail later, the substrate 26 beams ar array of receive antennas (not shown) each in the form of a pair of mutually orthogonal crossed dipoles. Each dipole is 0.4 cm in length, as appropriate for resonance at 16 Ghz at an alumina/air interface. The antennas are located on an outer surface **26*a* of the substrate remote from the lens 12. A microwave feed waveguide 28 connected to a microwave signal source (not shown) has an open output end 30 close to the substrate 26**.

The frusto-conical lens portion 16 has a second circular end face at 32 which is 1.752 cm from its first circular surface adjacent the first array 18. The lens portion 16 thus has an axial length of 1.752 cm. The second end face 32 is adjacent to an assembly indicated by 34 and incorporating a grid-consisting of a planar array of equispaced linear conductors, a transmit ant4nna array, an alumina substrate and sapcers therefor (not shown). The components of the assembly 34 will be described later in greater detail. The thickness of the assembly 34 locates the transmit antenna array in a plane perpendicular to the plane of the drawing, as indicated by the dashed line 36. The transmit antenna array plane is 0.148 cm from the second end face 32 and thus 1.9 cm from the first array 18 separating the lens portions 14 and 16. The assembly 34 is composed largely of alumina, and its thickness is one quarter of a wavelenght of radiation with a frequency of 16 GHz in an alumina medium with a dielectric constnat of 10. The transmit and receive antennas are consequently equidistant from the first array 18.

The assembly 34 is adjacent to a first waveguide 40 which is of larger dimensions than those appropriate for efficient transmission of radiation at the operating frequency. The first waveguide 40 is connected to a second waveguide 42. The second waveguide 42 has dimensions correctly proportioned for the operating frequency of 16 Ghz.

The sensor 10 also incorporates a second alumina lens 44 which is concavo-convex. The first and second lenses 12 and 44 form in combination a doublet lens system or compound lens having two focal planes. One focal plane arises from reflection at the first array 18 and transmission at the second array 20. It is coincident with the receive antenna array plane on the substrate surface **26*a*. The second focal plane arises from transmission through the first array 18 and the assembly 34 and is coincident with the transmit antenna array plane at 36. The focal planes at 26*a* and 36 are parallel to the first array 18** and on opposite sides of it.

Figure 2:
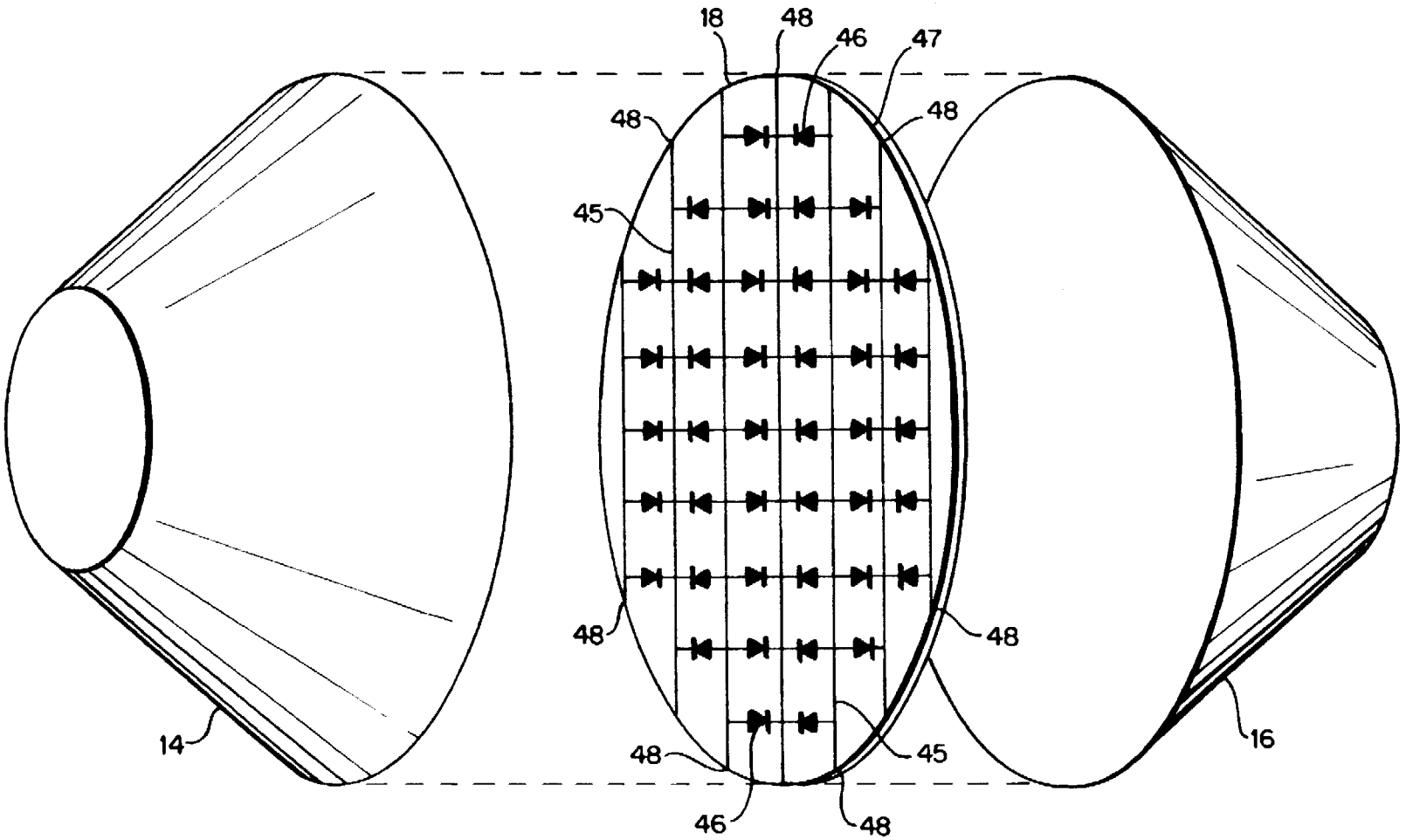
FIG. 2 schematically illustrates a disasembled view of a switchable radiation reflector within a dielectric lens for use in the FIG. 1 sensor.

Referring now to FIG. 2 also, there is shown the PIN diode array 18 together with the two lens portions 14 and 16. These components are shown in a disassembled state in FIG. 2, their assembled position with respect to one another having been shown in FIG. 1. The PIN diode array 18 is indicated schematically for clarity. The array 18 consists of a plurality of bias conductors 45 with didoes 46 disposed between them. The diodes and conductors are fabricated by known semiconductor processing techniques on a silicon wafer 47. Electrical contract to the conductors is made at the edge of the wafer at contact points 48. The array 20 has a similar configuration to the array 18 but has a smaller area, sufficient to shield the receive array from transmitted radiation.

Monolithic PIN diode arrays are described by A. Armstrong et al. in the September 1985 edition of the Microwave Journal on pages 197 to 201. The diode array 18 consists of a series of co-parallel bias conductors 45 with the diodes 46 disposed between them, the bias conductors 45 being parallel to the x axis and the diodes 46 linking the bias conductors being essentially parallel to the y axis. The spacing between the bias conductors and the sapcing between adjacent diodes are determined by the operating frequency of the sensor 10 and are less than a quarter of the wavelenght of the radiation within the lens dielectric medium. The spacings are such that radiation polarized parallel to the bias conductors is reflected efficiently, and when the didoes are frward biassed, radiation polarized orthogonally to the bias conductors is also reflected efficiently. In the diode array 18, the sapcings between bias conductors and between adjacent diodes are 1.4 mm.

The diode array 18 is fabricated on a single silicon wafer 47 which is 6.6 cm in diameter. In an alterantive arrangement (now shown), the diode array 18 consists of a mosaic of smaller arrays on silicon substrates bonded to an alumina wafer to form a single diode array 6.6 cm in diameter, with electrical connection to the bias conductors being made via through-hole plated contacts on the silicon substrates and conducting strips on the alumina wafer. The dielectric constant of silicon is approximately 11.7. This is sufficiently close to that of the alumina lens 12 to avoid a significant discontinuity in permittivity which would affect the lens properties.

When the diodes of the arrays 18 and 20 are reverse biassed RF radiation of frequency 16 Ghz with a polarization orthogonal to the bias conductors is transmitted through the array and 16 GHz RF radiation with a polarization parallel to the bias conductors is reflected. This is the array OFF state, and the diode array behaves in a similar manner to a grid of wires aligned parallel to the bias conductors. When the didoes are formed biassed by a DC bias current, the array reflect RF radiation having a polarization orthogonal to the bias conductors as well as RF radiation polarized parallel to the conductors, in this respect the diode array behaves in a similar manner to a mesh of crossed conducting wires; this is the array ON state. In the sensor 10 the bias conductors of arrays 18 and 20 are aligned parallel to the x axis indicated by the axes 11.

Figure 3:
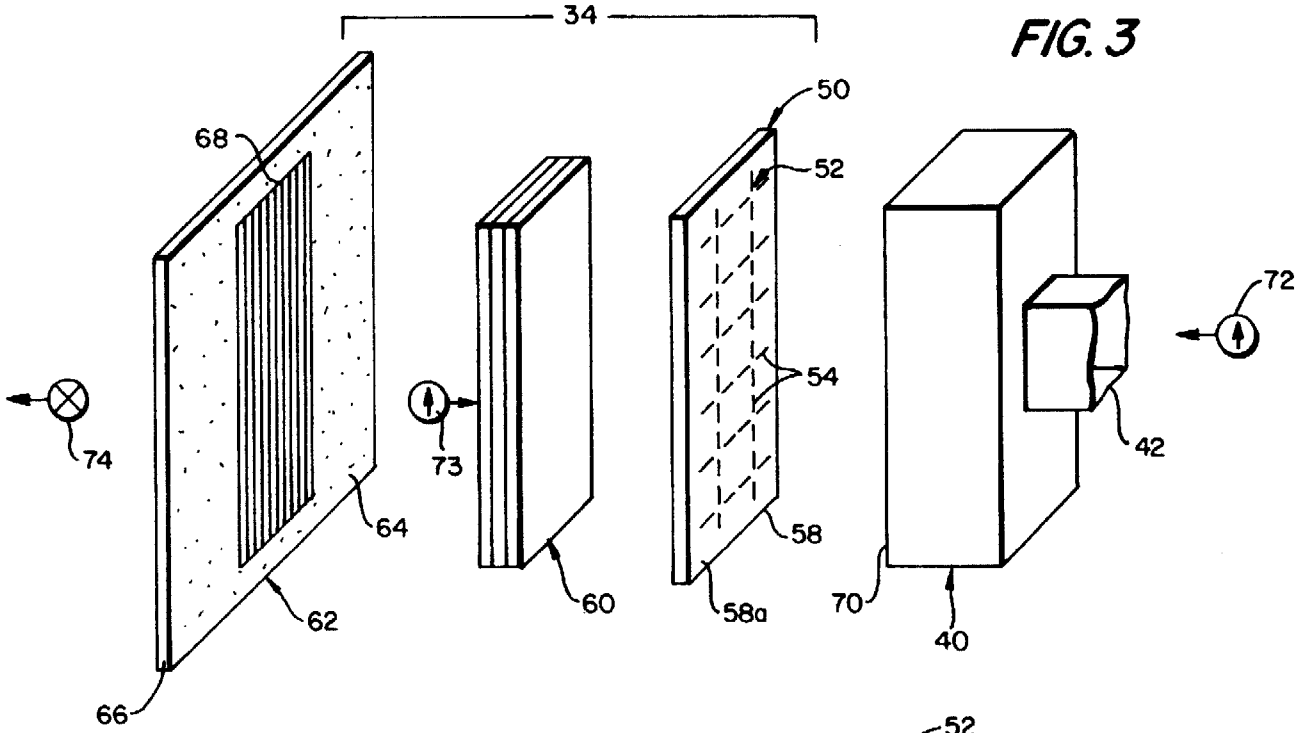
FIG. 3 is a disassembled view of a signal transmitting device for use in the FIG. 1 sensor.

Referring now also to FIG. 3, an exploded diagram of the assembly 34 and the first and second waveguides 40 and 42 is shown. The transmit antenna array is indicated generally by 50. It incoporates twelve antennas such as 52 arranged in a 6.33 2 array. The antennas 52 are indicated schematically by crosses.

Figure 4:
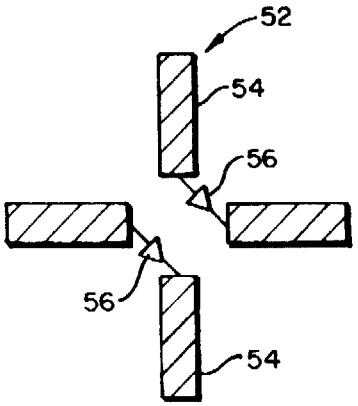
FIG. 4 schematically illustrates a polarization-switching antenna for use in the FIG. 3 device.

Each of the antennas 52 consists of a pair of mutally orthogonal planr metal dipoles, each dipole having a pair of rectangular limbs 54. The form of the transmit antennas is shown in FIG. 4.

Each dipole is 4 mm in length, and limbs 54 are 1.43 mm in length with a central space 1.14 mm in length. Adjacent antennas 52 have a centre-to-centre spacing of 4.5 mm. The limbs 54 are 0.4 mm in width, giving each dipole a lenght to width ratio of 10:1. This provides half wavelength dipole resonance at 16 GHz since it can be shown that the effective length of each dipole is its physical length multiplied by the square root of the average of the dielectric constants of the two media on either side of it. Since the antennas 52 have air on one side (dielectric constnat=1) and alumina (dielectric constant=10) on the other, their effective length is 9.38 mm, which is a half wavelength at 16 GHz in air.

Each dipole limb 54 is connected to a respective orthogonal dipole limb via a PIN diode switch 56, activated by a DC biasing current. Bias connections to the diode swtiches 56 are not shown. The antennas 52 are formed by deposition of metal on to a surface 58*a* of an alumina substrate 58. The substrate surface 58*a* is 35 mm×23 mm. The PIN diodes are discrete devices, so as hybrid electronic production process is required. Alternatively, the production of these diodes might be integrated into the production of the antennas in the substrate material.

The transmit antenna array 50 is separated by alumina spacers 60 from the grid of linear conductors indicated generally by 62. The latter is formed by deposition of a metal layer 64 (indicated by dots) on an alumina substrate 66. The layer 64 has a central region etched in a lithorgraphic process to define linear conductors 68 separated by sapces exposing the aluminia substrate. When arranged as the assembly 34, the conductors 68 are aligned parallel to the x axis, the sapcers 60 are in contact with the grid 62, and the transmit antenna array substrate 58 is in contact with the sapcers 60. The oversize first waveguide 40 has an end rim 70 which in use is assembled against the substrate surface 58*a*. The underlying surface of grid 62 (not shown) is in contact with the lens end face 32. The thicknesses of the antenna array substrate 58, the spacers 60, and the grid 62 are combined to locate he transmit antennas 52 in the second focal plane, indicated by the line 36, of the lens system 12 and 44.

The sensor 10 operates as follows. Microwave input power of frequency 16 Ghz is fed from a source (not shown) along the second waveguide 42. The microwave radition is polarized vertically, that is, with the electric field vector polarized parallel to the x axis, as indicated by encircled arrow 72. The input power passes into the first waveguide 40. When the sensor 10 is switched off, the radiation passes through the transmit antenna array to the grid 62 where it is reflected, as shown by the encircled arrow 73, since the electric field vector is parallel to the conductors 68. When the transmit antenna array is activated, as will be described, it absorbs the microwave radiation and re-radiates it with polarization rotated through 90°. This horizontally polarized radiation, with the electric field vector parallel to the y direction, is a transmit signal Tx which can pass through the grid 62 since the electric field vector is orthogonal to the conductors 68.

The horizontally polarized transmit signal Tx, indicated by an encircled cross 74, passes from the transmit antenna array into the frusto-conical lens portions 16. If the array 18 is in the ON state, the radiation is reflected back towards the transmit antenna array. If the array 18 is in the OFF state the transmit signal Tx passes through the array 18 and into the spherical cap lens portion 14. The array 20 is switched to the ON state when the array 18 is in the OFF state so as to reflect radition polarized both parallel to and orthogonal to the Tx polarization orientation and thereby prevent damage to the sensitive receive antenna components by the high power Tx signal. when the array 18 is switched to the ON state the array 20 is switched to the OFF state in which it transmits horizontally polarized radation. When the array 18 is in the OFF state the Tx signal passes through the lens portion 14 to air and thence to the second lens 44. The horizontally polarized transmit signal Tx, shown by the encircled cross 75, leaves the lens 44 as a parallel beam by vitrue of the transmit antenna array3 s location at a focal plane of the lens system 12 and 44.

The transmit signal Tx has a beam direction controlled by the transmit antenna array. Radiation passing from the transmit antenna array into the lens 12 is indicated by single arrows such as 76. The lens system 12 and 44 has an optical axis indicated by a dashed line 78; this is also the symmetry axis of the lens portions 14 and 16 and is parallel with the s axis. Activation of antennas at positions indicated by −15° to +15° below and above the optical axis gives rise to transmit beams 80 and 82 directed at −15° and +15° to this axis respectively. A central beam direction is indicated by 84 at 0° to the lens system optical axis, parallel with the z axis, this being the boresight of the sensor 10. The lens system 12 and 44 gives a field of view which is a 60° cone centred on the optical axis.

The transmit signal Tx may be reflected by an object in a remote scene (not shown) as a receive signal Rx reflected back towards the sensor 10. In order to detect the Rx signal, the first array 18 is switched to the ON state and so is reflective to the receive signal Rx irrespective of the signal's polarization orientation. The receive signal Rx returns along the transmit beam paths as indicated by double arrows such as 86 until the array 18 is reached. Because the array 18 is now reflective, it reflects the receive signal Rx towards the second array 20. The array 20 is in the OFF state and is thus transmissive to horizontally polarized radiation. The receive signal Rx reflected by the array 18 passes through the array 20 provided its plane of polarization has not been rotated from that of the Tx signal. The receive signal Rx passes to the receive antenna array located on the surface 26*a*. The receive antenna array obtains a further input from the microwave feed 28, this provides a vertically polarized local oscillator (Lo) signal. The receive antenna array mixes the receive signal Rx and the Lo signal to produce intermediate frequency (IF) signals suitable for subsequent signal processing in a known manner. The bias conductors of the array 20 assist coupling of the Lo signal to the receive antenna array. BEcause the bias conductors of the array 20 are parallel to the polarization of the Lo signal, the array 20 reflects the Lo signal back towards the receive antenna array.

Referring now to FIGS. 3 and 4 the operation of the transmit antenna array 50 will be described. When all the PIN diodes 56 are switched to an OFF state very little of the vertically polarized input radiation 72 is coupled to either dipole of each of the antennas 52 because of the antenna polar diagram. In consequence, the input radiation passes through the antenna array 50 and sapcers 60 largely unaffected. The rdiation is reflected back by the grid 62 as indicated at 73, since it is polarized parallel to the grid conductors 68. The radiation is therefore prevented from reaching the lens 12 for subsequent output to free sapce.

When one pair of diodes 56 associated with any one of the antennas 52 is activated to an ON state by applying a bias current, the vertically polarized radiation includes a microwave signal in that antenna's vertical dipole which becomes coupled to its associated horizontal dipole. This occurs by virture of the current path provided by each PIN diode 56 between orthogonal dipole limbs. Most of the energy received by the switched-on antenna 52 is coupled to its horizontal dipole and is subsequently re-radiated with horizontal polarization. As disclosed by Brewitt-Taylor et al. in Electronics Letters volume 17 (1981) pages 729–731, an antenna located at an interface between two media with differing dielectric constants radiates predominantly into the medium having the higher dielectric constant. Thus the antenna 52 re-rediates predominantly into the alumina substrate 58.

The re-radiated signal from the antenna array 50 passes through the spacers 60 to the grid 62. Since it is polarized horizontally and therefore orthogonally to the grid conductors 68, it passes through the grid 62 with very little reflection as indicated at 74. It then passes into the lens 12 to become the transmit signal Tx.

In operation, the direction and spatial extent of the transmit beam is determined by which of the transmit antennas 52 are activated. A re-radiated signal, which is horizontally polarized, originates at any antenna 52 which is activated. Since the antennas 52 are distributed over one of the focal planes of the lens system at 36, activation of a single antenna will give rise to a transmit beam direction determined by the antenna location. In FIG. 1, transmit beam directions are indicted which are aligned at =15° to a central boresight beam direction at 0°.

Referring now to FIGS. 5 and 6 together, the receive antenna array is shown. The antenna array is indicated generally by 100 in FIG. 5 and incorproates individual antennas 102 in a 6×2 array, shown schematically as crosses with a central square. FIG. 6 shows an individual receive antenna in greater detail. The receive antenna array 100 has antennas 102 with numbers, form and spacing like to those of the transmit antenna array 50. The two arrays 50 and 100 are disposed with their planes and long dimensions parallel. The receive antenna array 100 differs to the transmit antenna array 50 in that each antenna 102 incorporates a limb 104*a* which is longitudinally divided. In addition, each antenna 102 has a central ring of four RF mixer diodes 106*a* to 106*d*. Each of the diodes 106*a* to 106*d* is connected between a respective pair of limbs 104 of different orghogonal dipoles such as diode 106*c* between limbs 104*b* and 104*c*. The limbs 104*c* and 104*d* of one of the dipoles in FIG. 6 are connected to the anodes of the diode pairs 106*a*/106*b* and 106*c*/106*d* respectively. The limbs 104*a* and 104*b* of the other dipole are connected to the cathodes 106*a* to 106*d* are consequently polarized towards the limbs of one dipole and away from the limbs of the other. The divisions of the split limb 104*a* are connected to respective diodes 106*a* and 106*b*, and the antenna 102 is arranged so that the long dimensions of the limbs 104*a* and 104*b* are aligned parallel to the long dimension of the substrate 26. The long dimensions of limbs 104*a* and 104*b* are thus aligned parallel to the x axis, and the long dimensions of the limbs 104*c* and 104*d* are aligned parallel to the y axis, of FIG. 1.

The receive antenna array 100 operates as follows. Its long dimension is shown horizontal in FIG. 5 but vertical in FIG. 1. Receive radiation Rs of RF frequency 16 GHz is polarized parallel to the dipole 104*c*/104*d*. Local oscillator radiation from the horn 28 is parallel to the dipole 104*c*/104*d*. Local oscillator radiation from the horn 28 is polarized parallel to the split-limb dipole 104*a*/104*b*. The Lo and Tx radiations develop signals in the dipoles to which their polarizations are parallel, and these signals are mixed by the ring of diodes 106*a* to 106*d* to produce IF signals. The IF signals are at the difference frequency between the Lo and Tx signals. The split limb 104*a* appears as a single limb at frequencies of 16 GHz by viture of capacitive coupling between its limbs. At the IF however, it acts as two parallel conductors forming a transmission line. Consequently the split limb 104*a* provides an output feed for relaying IF signals to processing circuitry (not shown). Such circuitry is well known in the art and will not be described in detail. It may incorporate an IF amplifier and an analogue to digital converter for each antenna 102. Digital signals output from the converter may be fed to digital electronic circuits of known kind.

The radiation sensor 10 provides both transmit and receive capability within a common aperture defined by the optical aperture of the doublet lens system 12 and 44. Radiation reflections at surfaces of the doublet lens system due to boundaries between dissimilar dielectric media are suppressed by anti-reflection coatings of a known kind, similar to lens blooming in optical instruments.

The transmit antenna array 50 and first and second waveguides 40 and 42 shown in FIG. 3 may be replaced by a microwave signal source which is mechanically (rather than electronically) reloctable. A flexible coaxial signal feed is connected to a section of waveguide which provides power to a single, permanently short-circuited polarization switching antenna. The antenna is located in the lens focal plane 36 and radiates microwave power into the lens 12. The section of waveguide is movable along two mutually orthogonal axes in the focal plane 36 by stepper motors. This provides for the location of the transmit signal origin in the focal plane 36 to be appropriate to any one of a number of transmit beam directions.

In an alternative embodiment, the sensor 10 has a circular polarizer inserted between the lens 44 and a remote scene. The circular polarizer may be of a meander line printed circuit variety, as described in "IEEE Transactions on Antennas and Propagation" Volume AP-35 No. 6 June 1987 pages 652–661. On passing through the circular polarizer, the vertically polarized Tx signal becomes right hand circularly (RHC) polarized. The Rx signal reflected from a remote target towards the sensor may either be RHC or left hand circularly (LHC) polarized depending on the number of reflections which the signal has undergone. On passing through the circular polarizer, the Rx signal becomes vertically or horizontally polarized depending on whether the reflected signal is respectively RHC or LHC polarized. The PIN diode array 20, the receiver antenna array 100 and the Lo signal source may be oriented to detect either vertically or horizontally polarized radiation and thus monitor either the RHC or the LHC polarized component of the Rx signal.

I claim:

1. A radiation sensor comprising:

radiation guiding means for guiding radiation, the guiding means defining a first focal plane (26*a*) and a second focal plane (36) to or from which radiation is to pass, receiving means and transmitting means, one of said receiving means and transmitting means located in the vicinity of said first focal plane and the other of said receiving means and transmitting means located in the vicinity of said secon focal plane; and a switchable reflecting means (19) for selectably reflecting and transmitting incident radiation.

2. A radiation sensor according to claim 1 wherein, (a) the radiation guiding means (12) is a dielectric lens and the first and second planes (26*a*, 36) are respectively first and second focal planes of the dielectric lens at respective lens surface regions extending across an optical axis (78) of the lens;

(b) in the vicinity of the first focal plane there are radiation receiving means (100) for receiving radiation;

(c) in the vicinity of the second focal plane there are radiation transmitting means (50) for coupling radiation to the dielectric lens; and (d) the switchable reflecting means (18) is positioned within the dielectric lens and in a first state provides means for transmitting radiation with a first polarization orientation and for reflecting radiation with a second polarization orientation orthogonal to the first orientation, and in a second state provides means for reflecting radiation of both first and second polarization orientations.

3. A radiation sensor accroding to claim 1 wherein the switchable reflecting means (18) includes an array of semiconductor switches (46).

4. A radiation sensor according to claim 1, wherein the switchable reflecting means (18) includes an array of PIN diodes (46).

5. A radiation sensor according to claim 4 wherein the array of PIN diodes comprises a plurality of bias conductors (45) arranged to be substantially co-parallel and a plurality of PIN diodes (46) arranged to be electrically connected between the bias conductors.

6. A radiation sensor according to claim 2 wherein a second switchable reflecting means (20) is positioned within dielectric lens (12) and is arranged to protect the radiation receiving means (100) from radiation transmitted by the transmitting means (50).

7. A radiation sensor according to claim 2 wherein the dielectric lens (12) compirses two portions (14, 16) having spherical cap and frusto-conical shapes respectively.

8. A radiation sensor according to claim 1 wherein the switchable reflecting means (18, 20) is arranged to direct linearly polarized receive radiation (86) to the receiving means (100).

9. A radiation sensor including:

a converging dielectric lens (12) arranged to define an optical aperture and an optical axis (78) through the aperture said lens incorporates polarization-selective reflecting means (18) for defining first and second focal planes (26*a*, 36) at respective lens surface regions extending across the optical axis (78), the reflecting means (18) comprises means for controllably reflecting radiation of one polarization and transmitting radiation of another polarization, a receive array (100) of antennas is located in the vicinity of the first focal plane (26*a*), each antenna (102) of the array (100) being arranged to receive radiation entering the sensor from a respective beam direction relative to the optical axis and being coupled predominantly to radiation passing through the lens, and located in the vicinity of the second focal plane is a directionally selective transmitting means (52) for coupling radiation through the lens to a plurality of output beam directions.

10. A radiation sensor comprising:

a lens;

a switchable reflector for selectably performing the functions of reflecting and transmitting incident radiation;

a radiation detector; and a radiation transmitter, wherein said lens in combination with said switchable reflector has a first and a second focal plane and wherein said radiation detector and said radiation transmitter are each located in the vicinity of a respetive focal plane.

11. A radiation sensor according to claim 10 wherein:

said lens is a dielectric lens and said first and second focal planes are at respective lens surface regions extending across an optical axis of said lens;

said radiation detector is in the vicinity of said first focal plane;

said radiation transmitter is in the vicinity of said second focal plane for coupling radiation to said dielectric lens; and said switchable reflector is positioned within said dielectric lens and in a first state transmits radiation with a first polarization orientation and reflects radiation with a seocnd polarization orientation orthogonal to said first orientation, and in a second state reflects radiation of both first and second polarization orientations.

12. A radiation sensor according to claim 10 wherein said switchable reflector comprises an array of semiconductor switches.

13. A radiation sensor according to claim 10 whereins aid switchable reflector comprises an array of PIN diodes.

14. A radiation sensor according to claim 13 wherein said array of PIN diodes comprises a plurality of substantially co-parallel bias conductors and a plurlaity of PIN diodes electrically connected between said bias conductors.

15. A radiation sensor according to claim 11 wherein a second switchable reflector is positioned within said dielectric lens to protect said radiation detector from radiation coupled to said lens by said radiation transmitter.

16. A radiation sensor according to claim 11 wherein said dielectric lens comprises two portions, a first portion having a spherical cap shape and a second portion having a frustoconical shape.

17. A radiation sensor according to claim 10 wherein said switchable reflector provides means for directing linearly polarized receive radiation to said radiation detector.

18. A radiation sensor comprising:

a converging dielectric lens defining an optical aperture and ahving an optical axis through the aperture;

a switchable reflector, incorporated within said lens, for defining, in combiantion with said lens, first and second focal planes at respective lens surface regions extending across said optical axis and, in a first state, for reflecting radiation of one polarization and transmitting radiation of another polarization and, in a second state, for reflecting radiation of both polarizations;

a receive array of antennas located in the vicinity of said first focal plane, each antenna of said array providing means for receiving radiation entering the sensor from a respective beam direction relative to said optical axis and being coupled predominantly to radiation passing through said lens; and a directionally selective transmitter in the vicinity of said second focal plane for coupling radiation through the lens to a plurality of output beam directions.

* * * * *